US007063240B1

(12) United States Patent
Niswonger

(10) Patent No.: US 7,063,240 B1
(45) Date of Patent: Jun. 20, 2006

(54) POWERED CAULKING GUN

(76) Inventor: John O. H. Niswonger, 28947 Thousand Oaks Bl. #212, Agoura Hills, CA (US) 91301

( * ) Notice: Subject to any disclaimer, the term of this patent is extended or adjusted under 35 U.S.C. 154(b) by 0 days.

(21) Appl. No.: 10/834,478

(22) Filed: Apr. 29, 2004

Related U.S. Application Data

(60) Provisional application No. 60/492,587, filed on Aug. 4, 2003.

(51) Int. Cl.
*B67D 5/42* (2006.01)

(52) U.S. Cl. ..... 222/391; 222/1; 222/327; 222/333

(58) Field of Classification Search ..... 222/391, 222/333, 1, 325–327, 386; 74/111, 112, 74/122, 125.5
See application file for complete search history.

(56) References Cited

U.S. PATENT DOCUMENTS 2,367,346 A 1/1945 Good
2,928,574 A 3/1960 Wagner
3,401,847 A 9/1968 Downing
4,072,254 A 2/1978 Cox
4,171,072 A 10/1979 Davis, Jr.
4,264,021 A 4/1981 Davis, Jr.
4,273,269 A 6/1981 Davis, Jr.
5,775,539 A * 7/1998 Bates et al. ..... 222/1
6,135,327 A * 10/2000 Post et al. ..... 222/333

* cited by examiner

*Primary Examiner*—Frederick C. Nicolas
(74) *Attorney, Agent, or Firm*—Ronald Rohde; C. Bart Sullivan

(57) ABSTRACT

A caulking gun apparatus is described. In one embodiment the caulking gun includes an electric motor axially coupled to a plurality of cams having uneven surfaces thereon. In one aspect, the uneven surfaces are in slidable contact with at least one driving lever slidably positioned on a piston shaft. The piston shaft includes a piston end that is configured to engage with a cartridge used to dispense fluids such as caulk. The uneven surfaces are arranged relative one another such that when rotated, two or more of the cams about evenly exchange power transmission from the motor to the piston shaft to provide about an even fluid flow from a dispensing end of the cartridge.

20 Claims, 7 Drawing Sheets

POWERED CAULKING GUN

CROSS-REFERENCE TO RELATED APPLICATIONS

This invention is based on U.S. Provisional Patent Application Ser. No. 60/492,587 filed Aug. 4, 2003 entitled "Hand held Multi Cam Electric Caulking Gun" filed in the name of John O. H. Niswonger. The priority of this application is hereby claimed and it is hereby incorporated herein by reference thereto.

BACKGROUND OF THE INVENTION

1. Field of the Invention

Embodiments of the present invention generally relate to caulking guns.

2. Description of the Related Art

Generally, caulking guns are designed primarily for dispensing caulk packaged in a cylindrical container or cartridge. The cartridge has a dispensing nozzle on one end that dispenses caulk during a calking operation. The caulk is forced from the cartridge nozzle by forcing a movable wall end disposed within the cartridge toward the nozzle end. Conventionally, hand-held caulking guns use a piston type member, e.g., piston, driven by a shaft to push the movable wall. The piston member and shaft may be hand driven in a mechanical caulking gun as known. Unfortunately, such mechanical caulking guns during use often cause fatigue of the hand of the user thereby limiting the efficiency of the caulking operation. Further, due to varying levels of hand strength and gripping ability a user may apply a non-uniform hand-driven force thereby creating a non-uniform flow of caulk.

Electric caulking guns have been developed to help resolve such hand caulking issues by easing the work required by the user to move the movable wall end of the cartridge. Conventional electric caulking guns use a motor, such as a DC motor, in combination with a piston and shaft configured to apply force to the movable wall when a user activates the motor. Electric caulking guns are configured with a motion translation linkage that converts the motor rotation to linear piston motion. Some motion translation systems are designed to provide torque reduction to the motor so the motor size and therefore electrical energy consumption may be reduced. Unfortunately, such conventional motion transmission linkage is generally complicated thereby reducing the energy transmission between the motor rotation and the piston.

One type of transmission linkage is a single cam electric caulking gun. Such a single cam electric caulking gun uses a single cam motion to force the position forward while providing some torque reduction. Unfortunately, such a single cam only forces caulk forward when the cam is in a lifting portion of rotation and therefore provides no force to the piston during the cam return or retrograde portion of cam rotation to force the caulk forward. Such a change in caulking force causes a non-uniform flow of caulk from the cartridge.

Another type of transmission linkage is the screw type of linkage where the piston is rotatably coupled to a long screw on one end and the motor is coupled to the other end. While the screw provides an even caulking force when rotated, unfortunately, such a screw type of device requires a larger motor as little if any torque reduction may be derived therefrom. Conventionally gears are often used to provide such torque reduction. Unfortunately, gears add complexity and reduce the power transmission between the motor and piston. Moreover, a screw type linkage and gears increase the complexity of the portion of the apparatus dedicated to accommodating retraction of the piston for cartridge replacement.

Therefore, what is needed is a caulking gun that provides an even flow of caulk that is efficient to use, inexpensive to build and permits easy cartridge replacement.

SUMMARY OF THE INVENTION

An aspect of the present invention is a caulking gun apparatus configured to support a cartridge and dispense caulk from the cartridge. The apparatus includes a body configured to hold the cartridge in a dispensing position and a piston shaft configured to engage the cartridge for dispensing of the caulk. The piston shaft has a plurality of driving levers in slidable engagement with the piston shaft. The apparatus further includes a motor means disposed within the body coupled to a motor shaft and a plurality of cams axially coupled to the motor shaft. The plurality cams have uneven surfaces in slidable engagement with at least one of the plurality of driving levers and each of the uneven surfaces include at least one lifting surface and at least one retrograde surface. The lifting surfaces and the retrograde surfaces are positioned such that during rotation of the motor shaft, power transmission is provided from the motor to the piston shaft by the lifting surfaces. Furthermore, such power transmission is exchanged between two or more of the plurality of cams through two or more of the plurality of driving levers within a desired power transmission range.

Another aspect of the present invention is A caulking gun apparatus configured to support a cartridge and dispense caulk from the cartridge. The apparatus includes a body configured to hold the cartridge in a dispensing position and a motor means disposed within the body coupled to a motor shaft. The plurality of cams are axially coupled to the motor shaft, and a piston shaft is configured to engage the cartridge for dispensing of the caulk. The piston shaft has a plurality of driving levers in slidable engagement with the piston shaft. The plurality cams have surfaces in slidable engagement with at least one of the plurality of driving levers. The surfaces in slidable engagement describe a plane and each of the plurality of planes forms an acute angle with the motor shaft. The planes are positioned such that during rotation, power transmission from the motor to the piston shaft is exchanged between two or more of the plurality of cams through two or more of the plurality of driving levers within a desired power transmission range.

Another aspect of the present invention is a method for supporting a cartridge and dispensing caulk from the cartridge. The method includes configuring a body to hold the cartridge in a dispensing position, disposing a motor means within the body, and coupling the motor means to a plurality of cams, each cam having at least one cam surface. The method further includes configuring a piston shaft to engage the cartridge for dispensing of the caulk, engaging the piston shaft with a plurality of driving levers, slidably engaging the cam surfaces with at least one of the plurality of driving levers, and rotating the cams. The method further includes positioning the cam surfaces such that during rotation of the cams, power transmission from the motor to the piston shaft is exchanged between two or more of the plurality of cams through two or more of the plurality of driving levers within a desired power transmission range.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the present invention may admit to other equally effective embodiments.

DETAILED DESCRIPTION OF THE PREFERRED EMBODIMENT

In the following description, numerous specific details are set forth to provide a more thorough understanding of the present invention. However, it will be apparent to one of skill in the art that the present invention may be practiced without one or more of these specific details. In other instances, well-known features have not been described in order to avoid obscuring the present invention.

Figure 1:
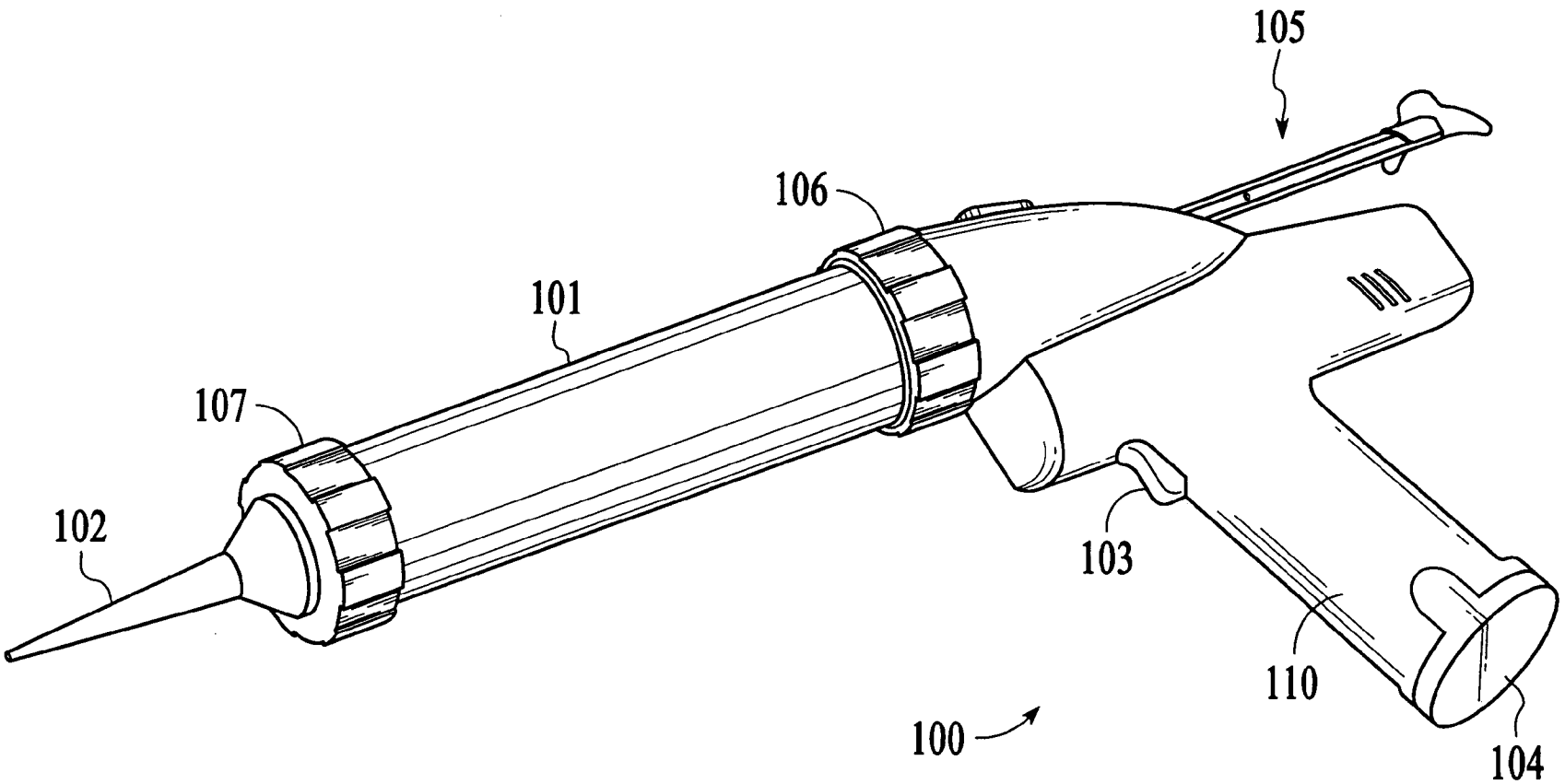
FIG. 1 is a perspective view of one embodiment an electric caulking gun in accordance with aspects of the invention.
Figure 2:
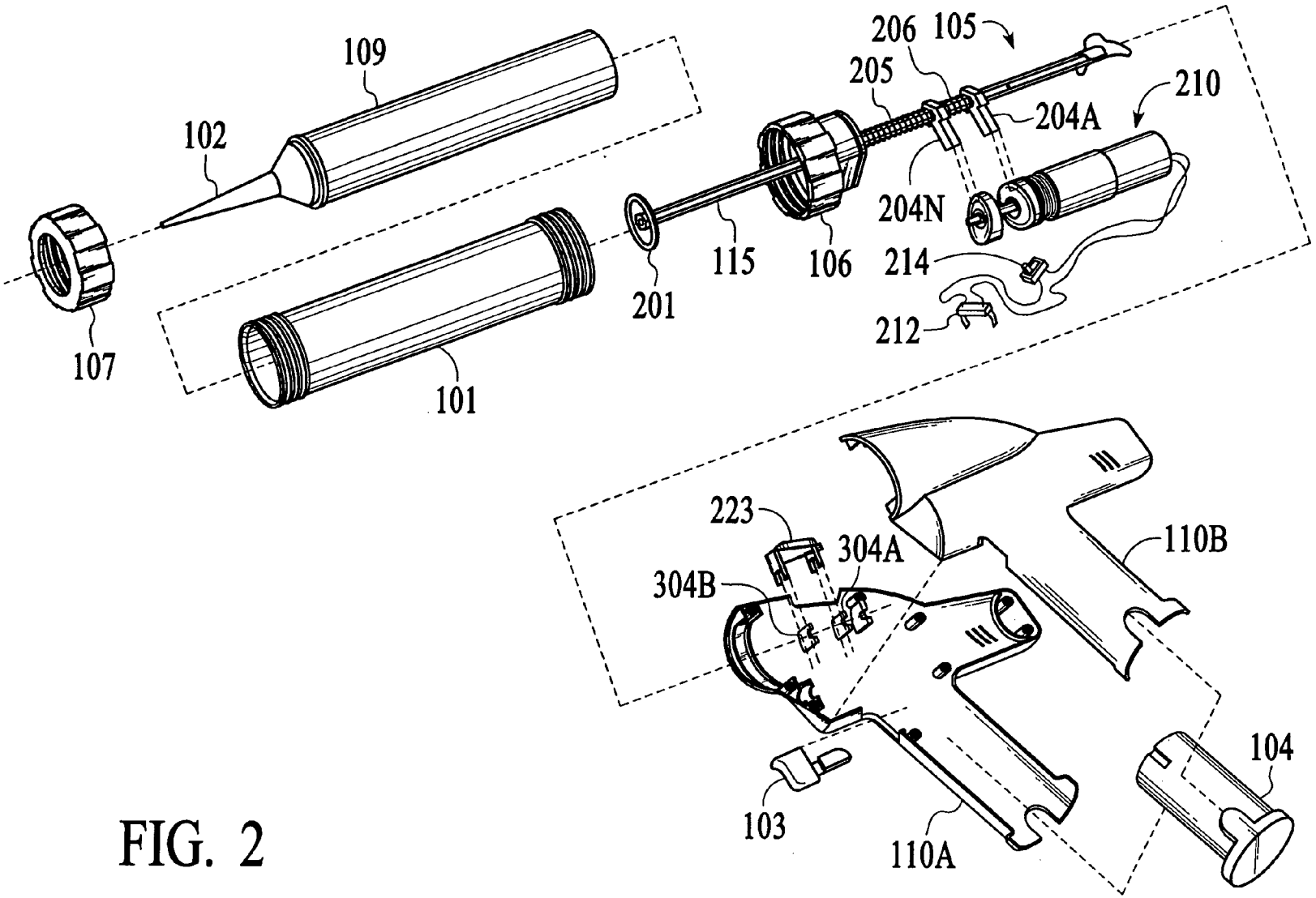
FIG. 2 is an exploded perspective view of one embodiment of the caulking gun of FIG. 1 in accordance with aspects of the invention.

FIG. 1 is a perspective view of one embodiment of an electric caulking gun 100 in accordance with aspects of the invention. FIG. 2 is an exploded perspective view of one embodiment of the electric caulking gun of FIG. 1, in accordance with aspects of the invention. Electric caulking gun 100 includes a body 110, a piston assembly 105, and a cartridge ring 106. Electric caulking gun 100 further includes a cartridge tube 101, a battery 104, a trigger 103, and a retaining ring 107. A dispensing nozzle 102 is illustrated extending from retaining ring 107. Cartridge ring 106 secures cartridge tube 101 to body 110. Electric caulking gun 100 further includes a motor assembly 210 and a release slide 223. Piston assembly 105 includes a piston shaft 115, a piston 201, an engagement spring 205, a driving lever 204A, another engagement spring 206, and another driving lever 204N. Engagement spring 205, driving lever 204A, second engagement spring 206, and driving lever 204N are described further below. A caulking cartridge 109 is illustrated internal to cartridge tube 101.

Caulking cartridge 109 is connected to dispensing nozzle 102. Caulking cartridge 109 and dispensing nozzle 102 are not part of electric caulking gun 100. Retaining ring 107 may be secured to cartridge tube 101. Dispensing nozzle 102 of caulking cartridge 109 extends therefrom. Cartridge tube 101 may be secured to cartridge ring 106. Piston 201 may be mounted axially, for example, on an end of piston shaft 115. Piston shaft 115 extends from piston 201 axially through cartridge ring 106. Engagement spring 205 is disposed axially on piston shaft 115 between cartridge ring 106 and first driving lever 204A. Engagement spring 206 is disposed axially on piston shaft 115 between driving lever 204A and driving lever 204N.

Body 110 may be constructed, for example from a body half 110A and another bodyhalf 110B. Body half 110A includes a plurality of shaft guides 304A,B to align and slideably hold piston shaft 115. Body half 110A and body half 110B are adapted to receive motor assembly 210, battery 104, cartridge ring 106, piston assembly 105, trigger 103, and slide release 223 therein. When assembled together, body half 110A and body half 110B may be configured to position and secure motor assembly 210, battery 104, cartridge ring 106, piston assembly 105, trigger 103, and slide release 223 in a functional relationship with respect to each other.

Motor assembly 210 includes a battery connector 212 electrically connected to a switch 214. Battery connector 212 is configured to connect battery 104 to motor 210 through switch 214. Trigger 103 is configured to close switch 214 as is known in the art. Switch 214 may be closed, for example, by sliding trigger 103 toward switch 214 to electrically short contacts associated therewith. When switch 214 is closed, battery 104 may provide electrical energy to motor assembly 210. Motor assembly 210 may be actuated by electrical energy supplied by battery 104 as is known. In one embodiment, motor assembly 210 may be configured to be actuated by alternate forms of energy, for example a pneumatic type of energy.

In one operational configuration, motor assembly 210 applies a force to driving levers 204A and 204N. Driving levers 204A and 204N transfer such force to piston shaft 115, urging piston shaft 115 in a direction of dispensing nozzle 102 as described more fully below. Piston shaft 115 advances through cartridge ring 106, transferring such force to piston 201 and thereby urging piston 201 into caulking cartridge 109. Piston 201 transfers such force to caulking cartridge 109 disposed within cartridge tube 101. Retaining ring 107 constrains caulking cartridge 109 inside of cartridge tube 101 against such force transferred to such caulking cartridge by piston 201. Caulking material, not illustrated, may thus be extruded from dispensing nozzle 102.

Figure 3:
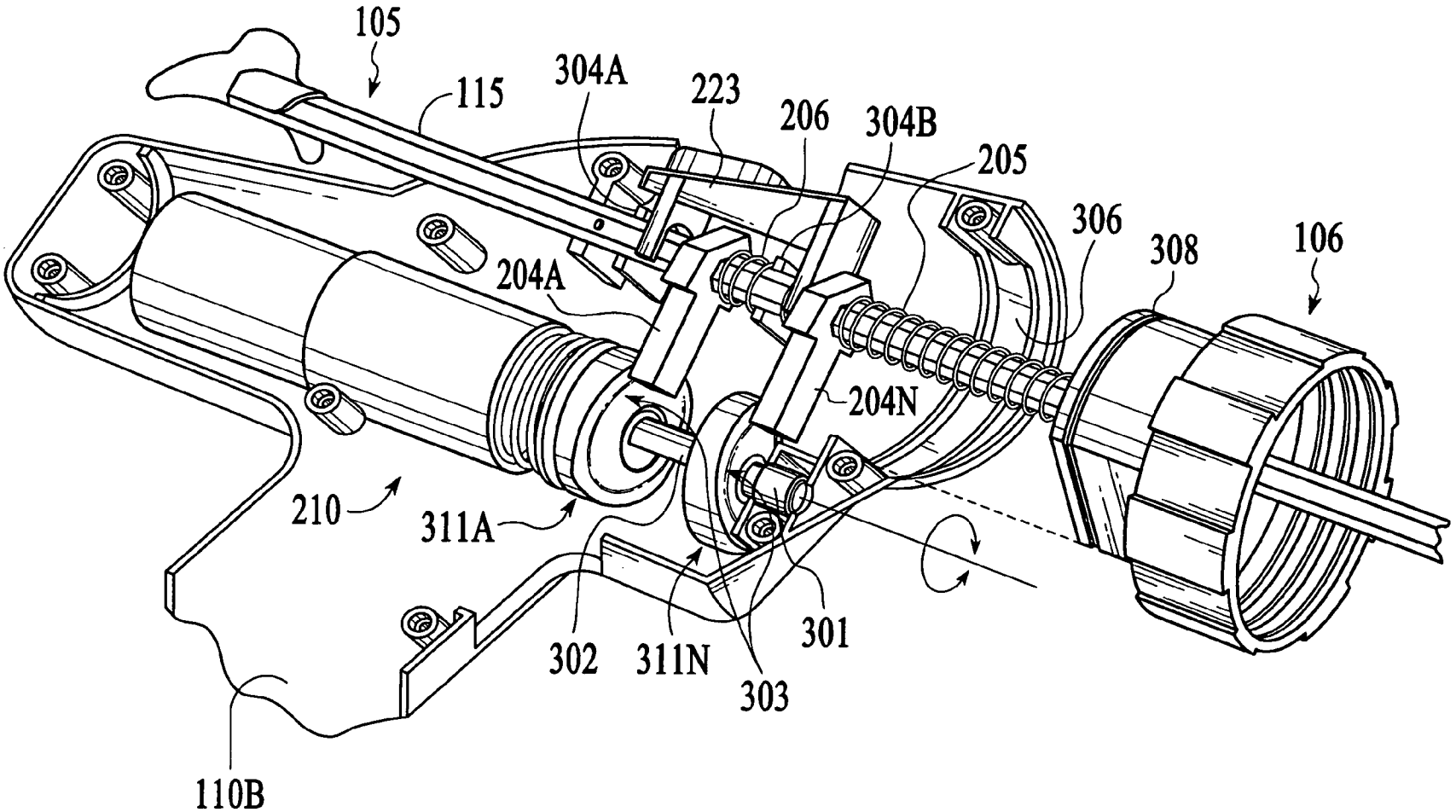
FIG. 3 is a perspective view of one embodiment of the caulking gun of FIG. 1 illustrating an arrangement of an electric motor assembly and a piston shaft assembly in a body half, in accordance with aspects the invention.

FIG. 3 is a perspective view of one embodiment of electric caulking gun 100 of FIG. 1 illustrating an arrangement of electric motor 210 and piston assembly 105 in body half 110B, in accordance with aspects the invention. A ring groove 306 may molded into body half 110 and is configured to accept a ring flange 308 of cartridge ring 106 to secure cartridge ring 106 therewith.

In one embodiment, electric motor assembly 210 includes a cam 311A, a cam 311N, a motor shaft 302, and a bushing 301. Cam 311N is defined herein to represent at least one cam 311A–N. Cam 311A and cam 311N are axially disposed on motor shaft 302. Cam 311A–N includes a cam face 303. Cam face 303 may define an uneven surface having a lifting phase (defined below) and a retrograde phase (defined below). Cam face 303 may alternatively define a surface, which is about planer. Bushing 301 is slideably disposed on motor shaft 302 and may be seated in body 110 to provide rotational stability to motor shaft 302. FIG. 3 illustrates an example of bushing 301 seated in body half 110B. Body half 110A (See FIG. 2) may secure bushing 301 to body half 110B. Bushing 301 secures and orients motor assembly 210 in an operational position. Cams 311A–N are configured to rotate with respect to rotation of motor assembly 210 in either a clockwise or counter clockwise rotation. Cams 311A–N are configured to transfer power from motor assembly 210 to piston shaft 115 as described further below. Body half 110A and body half 110B may be configured to slidably support slide release 223. In operation, slide release 223 is configured to engage with driving levers 204A and 204N to remove such power transfer therefrom. In one configuration, slide release 223 may be used to disengage driving levers 204A–N to stop a forward movement of piston shaft 115 and piston 201 as described herein.

Figure 4A:
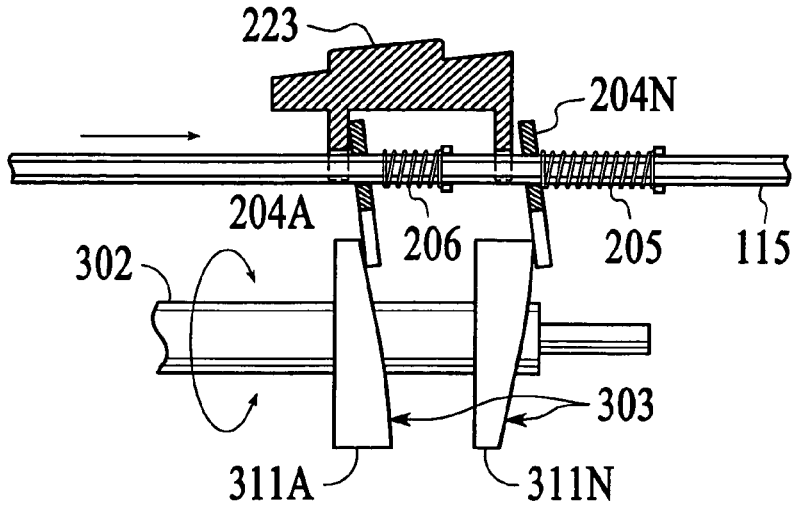
FIG. 4A is a side elevation view illustrating one embodiment of a plurality of driving levers in an engagement position with a plurality of cams, in accordance with aspects of the invention.

FIG. 4A is a side elevation view illustrating one embodiment of driving levers 204A–N of FIG. 2 and FIG. 3 in an engagement position with cams 311A–N, in accordance with aspects of the invention. In one operational configuration, motor shaft 302 rotates cams 311A and 311N about simultaneously. Cam 311N is illustrated engaging driving lever 204N during a lifting phase of cam 311N rotation. During such lifting phase of cam 311N rotation, cam 311N exerts a force within a predetermined range of power on driving lever 204N. In one operation illustrated in FIG. 4A, driving lever 204N is urged forward by cam 311N. Driving lever 204N grips piston shaft 115 in a jamb angle and translates such force from motor assembly 210 into a forward motion toward cartridge 109, forcing piston shaft 115 to advance in a forward direction (from left to right in FIG. 4A) in a direction of dispensing nozzle 102. During some portion of such lifting phase of cam 311N, cam 311A engages driving lever 204A in a retrograde phase. During such retrograde phase of such engagement of cam 311A, engagement spring 206 urges driving lever 204A to slide along piston shaft 115 in a retrograde direction (i.e., reverse direction), from right to left in FIG. 4A, e.g., an opposite direction of piston shaft 115.

Figure 4B:
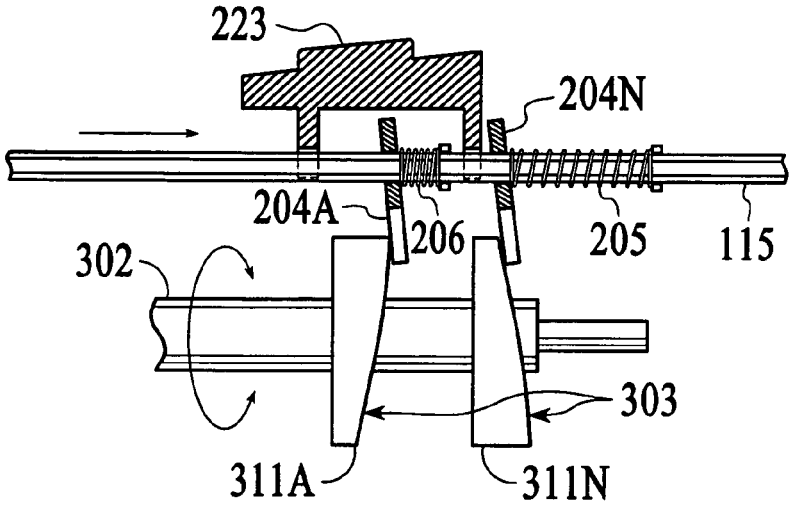
FIG. 4B is a side elevation view illustrating one embodiment of the plurality of driving levers in an engagement position with the plurality of cams in accordance with aspects of the invention.

FIG. 4B is a side elevation view illustrating one embodiment of the plurality of driving levers 204A–N in an engagement position with a plurality of cams 311A–N in accordance with aspects of the invention. In operation, motor shaft 302 is rotated such that cam 311A engages driving lever 204A in a lifting phase. During such lifting phase of cam 311A rotation, cam 311A exerts a force within a predetermined range of power on driving lever 204A. In one operation illustrated in FIG. 4B, driving lever 204A is urged forward by cam 311A. Driving lever 204A grips piston shaft 115 in a jamb angle and translates such force from motor assembly 210 into a forward motion, forcing piston shaft 115 to advance in a forward direction (from left to right in FIG. 4B) in a direction of dispensing nozzle 102. During some portion of such lifting phase of cam 311A, cam 311N engages driving lever 204N in a retrograde phase. During such retrograde phase of such engagement of cam 311N, engagement spring 205 urges driving lever 204N to slide along piston shaft 115 in a retrograde direction (i.e., reverse direction), from right to left in FIG. 4B, e.g., an opposite direction of piston shaft 115. Thus in operation, during rotation of motor shaft 302, cam 311A and respective driving lever 204A, and cam 311N and respective driving lever 204N are configured to cooperatively exchange and share power translation from motor assembly 210 to piston shaft 115. For example, cam 311A and driving lever 204A translate power to piston shaft 115 for a portion of a rotation of motor shaft 302 and cam 311N and respective driving lever 204N translate power to piston shaft 115 for another portion of a rotation of motor shaft 302.

In summary, each cam 311A–N and driving lever 204A–N operate similar to a cam member and a cam follower respectively, whereby such cam follower follows a surface of such cam member. In operation, as motor shaft 302 is rotated by motor assembly 210, cams 311A and 311N in conjunction with a respective driving lever 204A and driving lever 204N cooperate to urge piston shaft 115 forward, thereby pushing piston 201 forward through caulking cartridge 109. In one operational configuration, cams 311A and 311N are about 180 degrees out of phase, therefore when driving lever 204A is in a predetermined portion of a lifting phase with respect to cam 311A, driving lever 204N is in a retrograde phase with respect to cam 311N. Conversely, when driving lever 204N is in a predetermined portion of a lifting phase with respect to cam 311N, driving lever 204A is in a retrograde phase with respect to cam 311A. Thus, cam 311A and driving lever 204A and cam 311N and respective driving lever 204N work in unison to continuously move piston shaft 115 in a forward motion while each driving lever 204A–N moves, e.g., slides independently back and forth along a portion of piston shaft 115.

Figure 5:
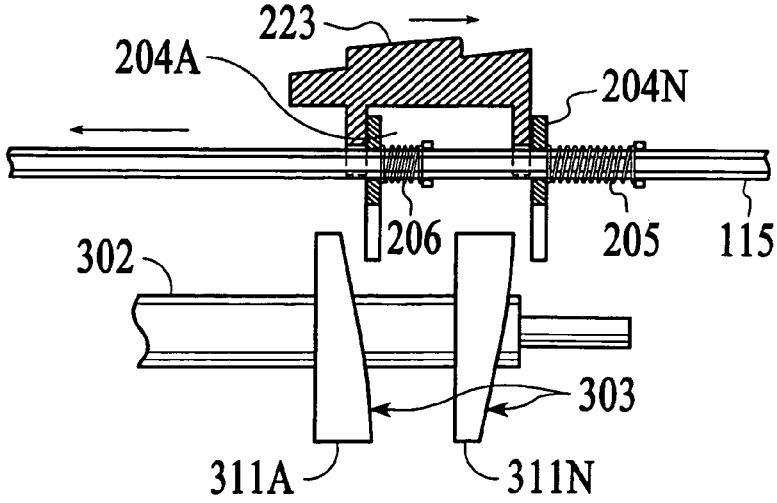
FIG. 5 is a side elevation view illustrating one embodiment of driving levers in a release position in accordance with aspects of the invention.

FIG. 5 is a side elevation view illustrating driving levers 204A–N in a release position, in accordance with aspects of the invention. A user of apparatus 100, for example, may force release slide 223 in a forward direction, e.g., toward caulking cartridge 109, which disengages driving lever 204A and driving lever 204N from cam 204A and cam 204N respectively. With driving lever 204A and driving lever 204N disengaged, piston shaft 115 may be pulled in the retrograde direction regardless of phase of cam 311A–N by such user. Thus, in operation release slide 223 may be used to disengage power transmission from motor assembly 210 to piston 201, and may be used to allow piston shaft 115 to be repositioned with respect to caulking cartridge 109.

Figure 6B:
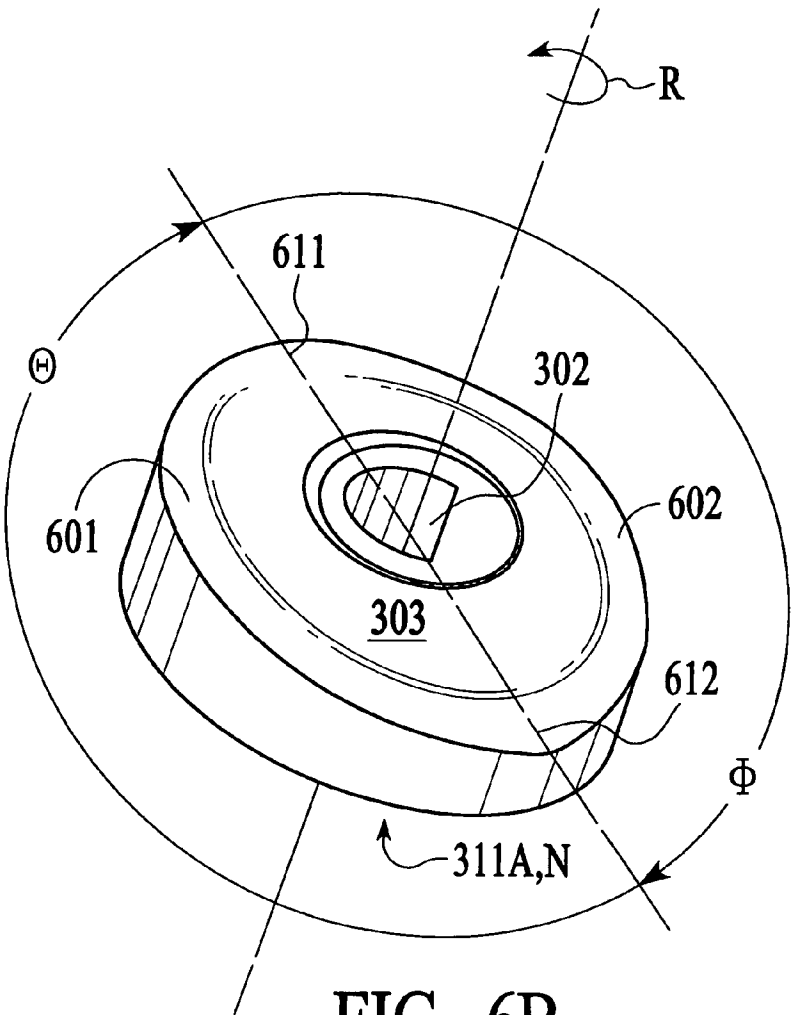
FIG. 6B is a perspective view illustrating one embodiment of the cam of FIG. 6A in accordance with aspects of the invention.
Figure 6A:
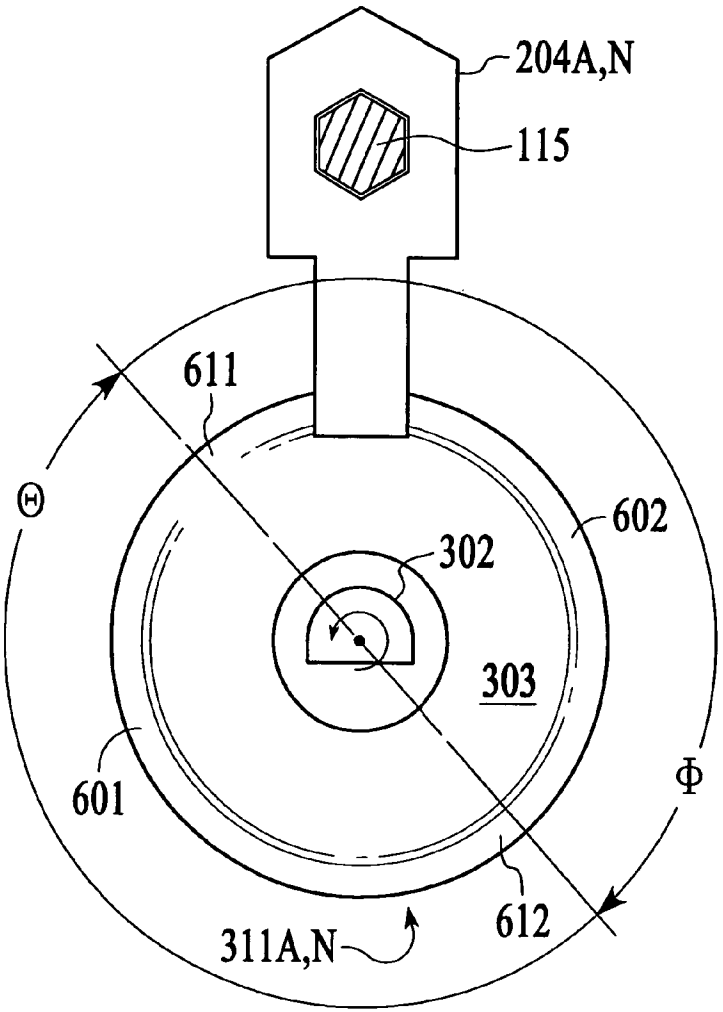
FIG. 6A is a plan view illustrating one embodiment of a cam engaged with a driving lever in accordance with aspects of the invention.

FIG. 6A is a plan view illustrating one of cams 311A–N engaged with a respective one of driving levers 204A–N, in accordance with aspects of the invention. FIG. 6B is a perspective view further illustrating cam 311A–N of FIG. 6A, in accordance with aspects of the invention. Cams 311A–N are coupled to motor shaft 302 as illustrated in FIGS. 6A and 6B. In one embodiment, motor shaft 302 is configured to maintain cam 311A–N rotation with respect to motor shaft 302. For example, motor shaft 302 may be configured with a "D" shape, as illustrated in FIG. 6A, however other rotation inhibiting shapes are contemplated such as a square shape, an oval shape, hexagon, and the like. In one configuration, piston shaft 115 may be shaped to prevent driving lever 204A–N from rotating away from respective cam 311A–N engaged therewith. For example, such piston shaft 115 may be shaped with a non-round shape such as a hexagonal shape, oval shape, square shape, rectangular shape, and the like.

In one configuration, cam face 303 includes lifting face 601 and a retrograde face 602. As illustrated in FIG. 6B, for example, when cam 311A–N may be viewed in perspective, lifting face 601 and retrograde face 602 form an uneven surface in cam face 303 of cam 311A–N. A lowest point on uneven surface of cam face 303 may be represented as a retrograde point 612. A highest point of uneven surface of cam face 303 relative retrograde point 612 may be represented by a peak point 611. Such retrograde point 612 and peak point 611 are merely illustrative, as cam face 303 surface may include a plurality of high and low surfaces thereon. While FIG. 6A and FIG. 6B illustrate an example of one embodiment of an uneven surface for cam face 303 for cam 311A and 311N, such an uneven surface of cam face 303 is not constrained to be identical for each of cams 311A–N.

In one embodiment, moving clockwise for example, lifting face 601 extends from about retrograde point 612 along and around a perimeter of an uneven surface of cam face 303, to about peak point 611. Retrograde face extends from about peak point 611 around and along perimeter of such an uneven surface of cam face 303 to about retrograde point 612. Following lifting face 601 from about retrograde point 612, in a clockwise direction for example, along perimeter of such uneven surface of cam face 303, lifting face 601 may progressively extend higher with respect to retrograde point 612 until reaching peak point 611. Following retrograde face 602 from peak point 611, in a clockwise direction for example, along perimeter of uneven surface of cam face 303, retrograde face 602 may progressively descend lower with respect to peak point 611 until reaching retrograde point 612. For example, a portion of lifting face 601 may be sloped to extend further out from cam 311A–N relative to retrograde point 612. As illustrated in FIGS. 4A–C, for example, when viewed from the side of cam 311A–N lifting face 601 and retrograde face 602 form such an uneven surface of cam face 303 of cam 311A–N which is configured to provide cam action to driving lever 204A–N. While FIGS. 6A and 6B illustrate an example of a cam face 303 in which lifting face 601 extends progressively higher with respect to retrograde point 612 while moving in a clockwise direction, a cam face 303 may be configured to extend progressively higher with respect to retrograde point 612 while moving in a counter-clockwise direction. Similarly, retrograde face 602 may descend progressively lower with respect to peak point 611 while moving in a counter-clockwise direction.

In one embodiment, lifting face 601 is a portion of uneven surface of cam face 303 defined by an angle $\Theta$, while retrograde face 602 is a portion of uneven surface of cam face 303 defined by angle $\phi$. During operation, motor assembly 210 rotates motor shaft 302 (See FIGS. 2 and 3). As motor shaft 302 rotates cam 311A–N, driving lever 204A–N engages cam 311A–N alternately at lifting face 601, and retrograde face 602. In FIG. 6A, cam 311A–N illustrates an example of driving lever 204A–N engaging cam 311A–N at retrograde face 602. A lifting phase for any cam 311A–N may be defined as a set of all rotational angles of motor shaft 302 that place respective driving lever 204A–N in engagement with cam 311A–N in some portion of such cam 311A–N lifting surface. Similarly, a retrograde phase for any cam 311A–N may be defined as a set of all rotational angles of motor shaft 302 that place respective driving lever 204A–N in engagement with cam 311A–N in some portion of such cam 311A–N retrograde surface. For example, when motor shaft 302 is positioned such that driving lever 204A engages cam 311A at lifting face 601, cam 311A is in lifting phase. When motor shaft 302 is positioned such that driving lever 204A engages cam 311A at retrograde face 602, cam 311A is in retrograde phase. Similarly, when motor shaft 302 is positioned such that driving lever 204N engages cam 311N at lifting face 601, cam 311N is in lifting phase. When motor shaft 302 is positioned such that driving lever 204N engages cam 311N at retrograde face 602, cam 311N is in retrograde phase.

For clarity, only two cams 311A and 311N along with respective driving levers 204A and 204N are illustrated herein. However, it is contemplated that virtually any cam 311A–N combination greater than one may be used to advantage. For example, in one embodiment, cam 311A and cam 311N along with respective driving levers 204A and 204N may represent three cams 311A–N along with three respective driving levers 204A–N. In such a three cam 311A–N and three driving lever 204A–N arrangement, respective lifting surfaces, e.g., lifting surface 601, may be aligned such that each of such three cam and driving lever arrangements cooperate to provide about continuous forward motion to piston shaft 115 during rotation of motor shaft 302.

Figure 7B:
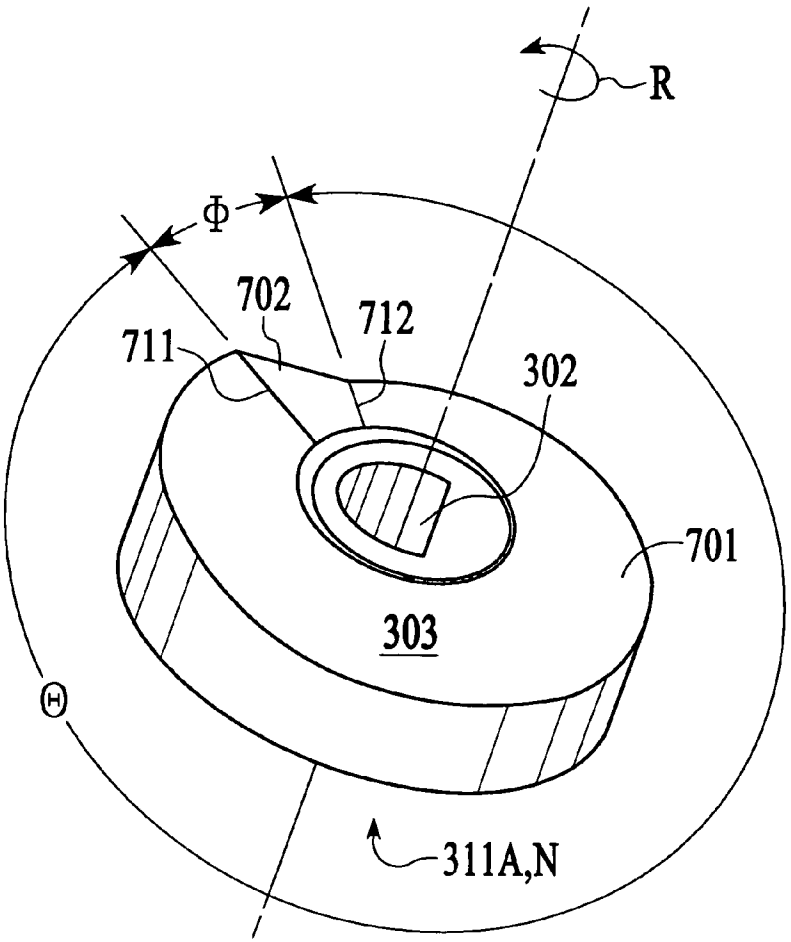
FIG. 7B is a perspective view illustrating one embodiment of the cam of FIG. 7A in accordance with aspects of the invention.
Figure 7A:
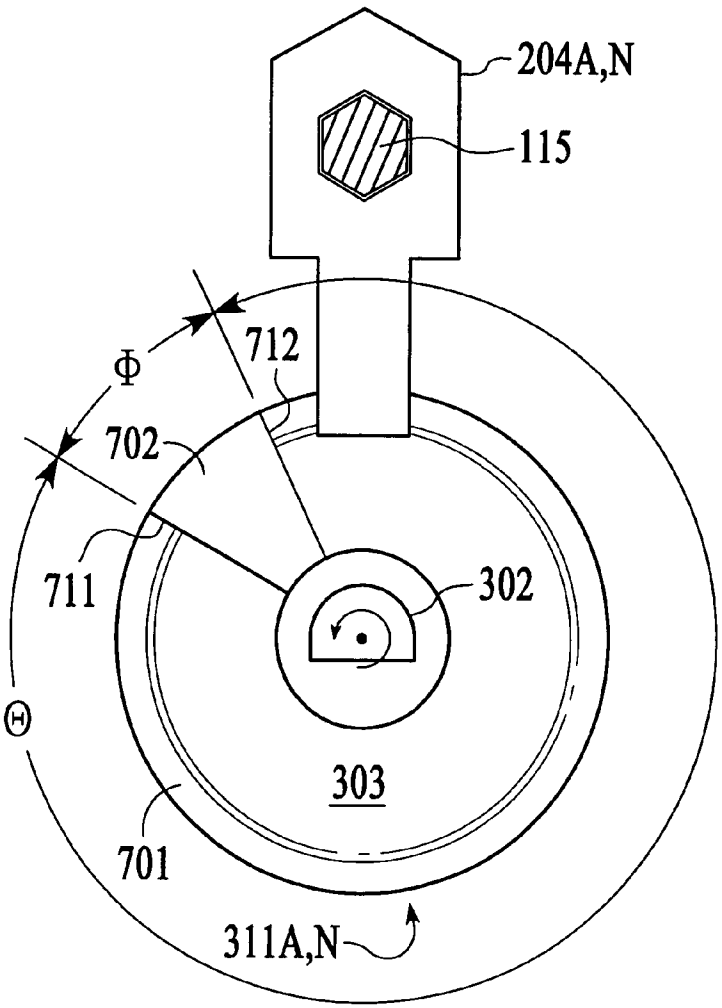
FIG. 7A is a plan view illustrating one embodiment of a cam engaged with a driving lever in accordance with aspects of the invention.

FIG. 7A is a plan view illustrating one embodiment of cam 311A–N engaged with a respective one of driving levers 204A–N, in accordance with aspects of the invention. FIG. 7B is a perspective view illustrating cam 311A–N of FIG. 7A, in accordance with aspects of the invention. This is just one embodiment of cam 311A–N illustrating an uneven surface of cam face 303. In one configuration, cam face 303 includes a lifting face 701 and a retrograde face 702. As illustrated in FIG. 7B, for example, when cam 311A–N may be viewed in perspective, lifting face 701 and retrograde face 702 form an uneven surface in cam face 303 of cam 311A–N. A lowest point on such an uneven surface of cam face 303 may be represented as a retrograde point 712. A highest point of uneven surface of cam face 303 relative retrograde point 712 may be represented by a peak point 711. Such retrograde point 712 and peak point 711 are merely illustrative as surface of cam face 303 may include a plurality of high and low surfaces thereon. While FIG. 7A and FIG. 7B illustrate an example of a common cam face 303 for cam 311A and 311N, uneven surface of cam face 303 is not constrained to be identical for each of cams 311A–N.

Lifting face 701 extends in a clockwise direction, for example, from about retrograde point 712 along and around a perimeter of uneven surface of cam face 303, to about peak point 711. Retrograde face 702 extends in the clockwise direction, for example, from about peak point 711 around and along perimeter of uneven surface of cam face 303 to about retrograde point 712. Following lifting face 701 from about retrograde point 712, in a clockwise direction along perimeter of uneven surface of cam face 303, lifting face 701 may progressively extend higher with respect to retrograde point 712 until reaching peak point 711. Following retrograde face 702 from peak point 711, in a clockwise direction along perimeter of uneven surface of cam face 303, retrograde face 702 may progressively descend lower with respect to peak point 711 until reaching retrograde point 712. While FIGS. 7A and 7B illustrate an example of a cam face 303 in which lifting face 701 extends progressively higher with respect to retrograde point 712 while moving in a clockwise direction, a cam face 303 may be configured to extend progressively higher with respect to retrograde point 712 while moving in a counter-clockwise direction. Similarly, retrograde face 702 may descend progressively lower with respect to peak point 711 while moving in a counter-clockwise direction.

In one embodiment, lifting surface 701 occupies an angle ⊖ of uneven surface of cam face 303, which may be a substantial portion of 360 degrees for example more than about 180 degrees, while retrograde surface 702 occupies an angle ϕ of uneven surface of cam face 303, which may be minor portion of 360 degrees, for example less than about 180 degrees. Angle ⊖ and angle ϕ may be configured to define a plurality of different lifting faces 701 and retrograde faces 702 in uneven surface of cam face 303, that may be used to advantage. For example, angle ⊖ and angle ϕ may be configured to be small relative to 360 degrees such that a plurality of lifting faces 701 and retrograde faces 702 occur within a 360-degree rotation of uneven face of cam face 303. It is important that angle ⊖ and angle ϕ may be selected and cam 311A oriented with respect to cam 311N so that at least one of cam 311A or cam 311N is oriented in a lifting phase during about the entire 360 degrees of rotation of motor shaft 302.

During operation, motor assembly 210 rotates motor shaft 302 (See FIGS. 2 and 3). As motor shaft 302 rotates cam 311A–N driving lever 204A–N engages cam 311A–N alternately at lifting face 701, and retrograde face 702. In FIG. 7A, cam 311A–N illustrates an example of driving lever 204A–N engaging cam 311A–N at lifting face 701. Again, as in FIG. 6A and FIG. 6B, a lifting phase for any cam 311A–N may be defined as a set of all rotational angles of motor shaft 302 that place respective driving lever 204A–N in engagement with cam 311A–N in some portion of such cam 311A–N lifting surface. Similarly, a retrograde phase for any cam 311A–N may be defined as a set of all rotational angles of motor shaft 302 that place respective driving lever 204A–N in engagement with cam 311A–N in some portion of such cam 311A–N retrograde surface. For example, when motor shaft 302 is positioned such that driving lever 204A engages cam 311A at lifting face 701, cam 311A is in a lifting phase. When motor shaft 302 is positioned such that driving lever 204A engages cam 311A at retrograde face 702, cam 311A is in a retrograde phase. Similarly, when motor shaft 302 is positioned such that driving lever 204N engages cam 311N at lifting face 701, cam 311N is in a lifting phase. When motor shaft 302 is positioned such that driving lever 204N engages cam 311N at retrograde face 702, cam 311N is in a retrograde phase.

For clarity, as described herein, only two cams 311A and 311N along with respective driving levers 204A and 204N are shown. However, it is contemplated that virtually any cam 311A–N combination greater than one may be used to advantage. For example, in one embodiment, cam 311A and cam 311N along with respective driving levers 204A and 204N may represent three cams 311A–N along with three respective driving levers 204A–N. In such a three cam 311A–N and three driving lever 204A–N arrangement, respective lifting surfaces, e.g., lifting surface 701, may be aligned such that each of such three cam and driving lever arrangements cooperate to provide about continuous forward motion to piston shaft 115 during rotation of motor shaft 302.

Figure 8:
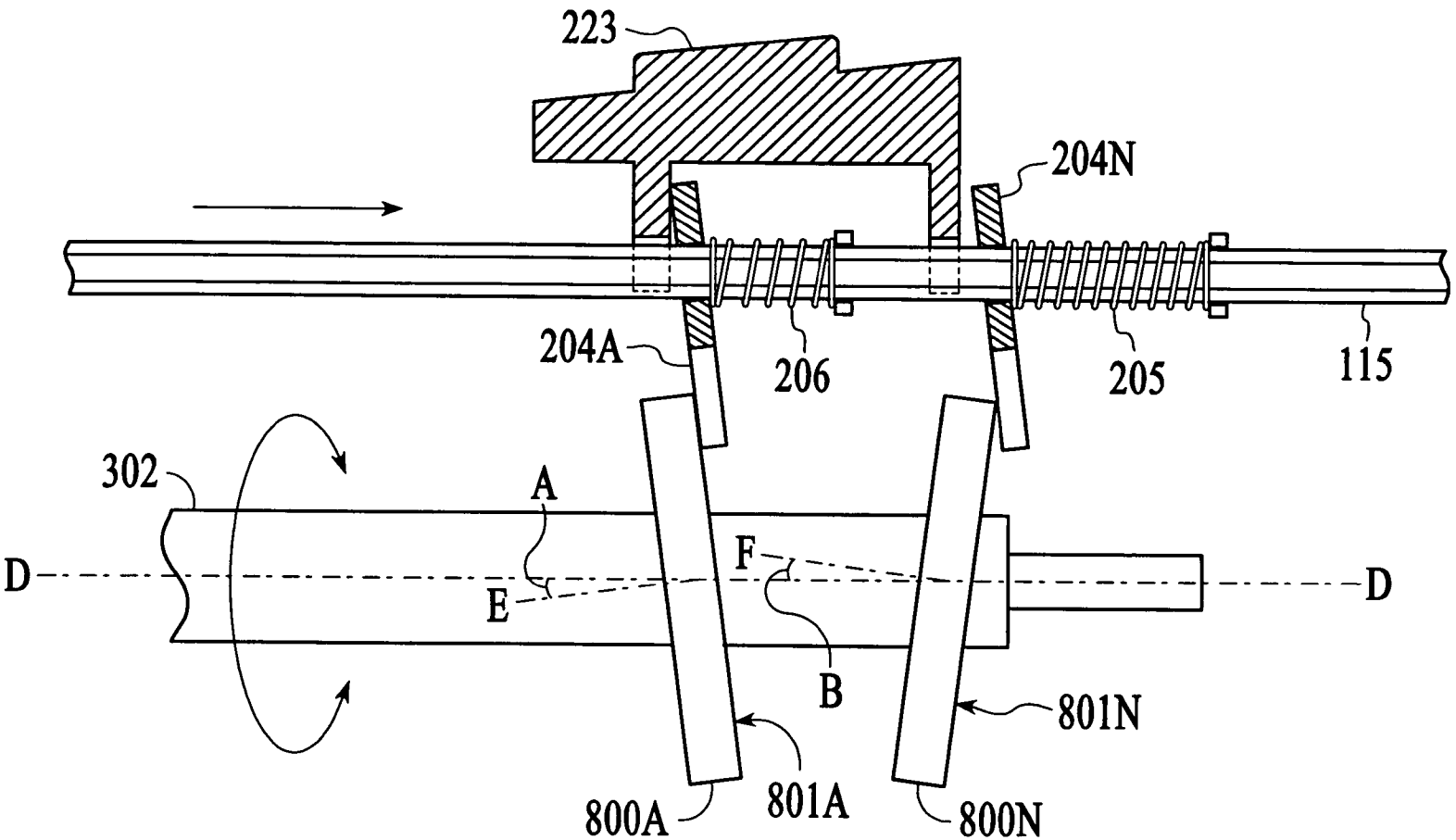
FIG. 8 is a side elevation illustrating one embodiment of a plurality of planer cams in accordance with aspects of the invention.

FIG. 8 is a side elevation illustrating one embodiment of a plurality of planer cams 800A and 800N, in accordance with aspects of the invention. A line D may be an axis of motor shaft 302. Cam 800A has a planer cam face 801A, A line E may be a normal to planer cam face 801A and intersecting line D. An angle A is formed between line E and intersecting line D. Angle A defines a "tilt" of planer cam surface 801A with respect to line D.

Cam 800N has a planer cam face 801N. A line F may be a normal planer cam face 801N and intersecting line D. An angle N is formed between line F and line D. Angle N defines a "tilt" of planer cam surface 801N with respect to line D.

Cam 800A and cam 800N may be mounted at a respective angle A and N relative a longitudinal axis D of motor shaft 302. Such angles A and N are configured so that during rotation of motor shaft 302, cam 800A provides planer cam face 801A that moves forward and backward with a cam motion relative to driving lever 204A and piston 201. Therefore, in one rotation position, planer cam face 801A is positioned relative driving lever 204A such that about zero forward pressure is applied to driving lever 204A, while in another rotation position cam face 303A extends further toward driving lever 204A to urge piston shaft 115 and piston 201 forward. Similarly, cam 800N provides cam face 801N that moves forward and backward with a cam motion relative to driving lever 204N and piston 201. Therefore, in one rotation position, cam face 303N is positioned relative driving lever 204N such that about zero forward pressure is applied to driving lever 204N, while in another rotation position cam face 303N extends further toward driving lever 204N to urge piston shaft 115 and piston 201 forward. In one configuration, for example, cam face 303A and cam face 303N are aligned relative motor shaft 302 such that while one cam face 303A–N is providing forward pressure on a respective driving lever 204A–N, another surface 204A–N is allowing a respective driving lever 204A–N to be released and forced in a retrograde direction along piston shaft 115 by respective engagement springs 205 and 206. For example, consider the case where cam face 303A may urge piston shaft 115 forward while cam face 303N is releasing driving lever 204N to allow such driving lever 204N to retract along piston shaft 115.

For clarity, as described herein, only two cams 800A and 800N along with respective driving levers 204A and 204N are shown. However, it is contemplated that virtually any cam 800A–N combination greater than one may be used to advantage. For example, in one embodiment, cams 800A and 800N along with respective driving levers 204A and 204N may represent three cams 800A–N along with three respective driving levers 204A–N. In such a three cam 800A–N and three driving lever 204A–N arrangement, respective lifting faces, e.g., cam face 303, may be aligned such that each of such three cam and driving lever arrangements cooperate to provide about continuous forward motion to piston shaft 115 during rotation of motor shaft 302.

In a case of an apparatus having for example two cams 800A–N, as described above Line E and line D define a first cam axial plane. Line F and line D define a second cam axial plane. The first cam plane and the second cam axial plane have line D in common and may be separated by phase angle of about 180 degrees. In a case of an apparatus having for example three cams a third cam axial plane may be determined analogous to the first cam axial plane and the second cam axial plane. All three cam axial planes have line D in common and may be separated by a phase angle of about 120 degrees. In a general case of an apparatus having N cams, N cam axial planes may be defined, all having line D in common. A phase angle between each adjacent pair of cam axial planes may be about 360 divided by an N number of cams. As described herein, cam 800A is tilted at an angle A and cam 800N is tilted at an angle N to a respective longitudinal axis D. For a configuration of two or more cams 800A–N each respective cam 800A–N is tilted at a respective angle A–B configured to impart about continuous forward motion on piston shaft 115. For example, consider the case of two cams 800A–N, angle A and N are configured such that as cams 800A and 800N are rotated out of phase about 180 degrees. For a case of three cams 800A–N, angle A–N is configured such that such three cams 800A–N are out of phase about 120 degrees. Thus, an associated phase relationship between cams 800A–N may be computed using the following formula:

$$\text{cam relative phase}=360\text{ degrees}/(\text{no. of cams}) \quad (1)$$

Where cam relative phase is the relative position along a common longitudinal axis D of each cam 800A–N, e.g., the relative radial position of each cam 800A–N with respect to a rotation of motor shaft 302.

While the foregoing is directed to embodiments of the present invention, other and further embodiments of the invention may be devised without departing from the basic scope thereof, and the scope thereof is determined by the claims that follow.

The invention claimed is:

1. A caulking gun apparatus configured to support a cartridge and dispense caulk from the cartridge, the apparatus comprising:

a body configured to hold the cartridge in a dispensing position, a piston shaft configured to engage the cartridge for dispensing of the caulk, the piston shaft having a plurality of driving levers in slidable engagement therewith;

a motor means disposed within the body coupled to a motor shaft; and a plurality of cams axially coupled to the motor shaft, at least one cam of the plurality of cams having uneven surfaces in slidable engagement with at least one driving lever of the plurality of driving levers;

at least one other cam of the plurality of cams having uneven surfaces in slidable engagement with at least one other driving lever of the plurality of driving levers;

each of the uneven surfaces including at least one lifting surface and at least one retrograde surface;

the lifting surfaces and the retrograde surfaces being positioned such that during rotation of the motor shaft, power transmission is provided from the motor to the piston shaft by the lifting surfaces, wherein the power is exchanged between the at least one cam and the at least one other cam through the at least one driving lever and the at least one other driving lever within a desired power transmission range.

2. The apparatus of claim 1, wherein each of the at least one cam and the at least one other cam has at least one lifting surface defining a cam lifting phase, and at least one retrograde surface defining a cam retrograde phase.

3. The apparatus of claim 2, wherein the at least one cam retrograde phase of one cam is aligned to occur during at least a portion of the cam lifting phase at least one other cam.

4. The apparatus of claim 1, wherein each of the at least one cam and the at least one other cam has one lifting surface defining a cam lifting phase, and one retrograde surface defining a cam retrograde phase.

5. The apparatus of claim 4, wherein the cam retrograde phase of one cam is aligned to occur during at least a portion of the cam lifting phase of at least one other cam.

6. The apparatus of claim 5, wherein the cam lifting phase is substantially greater than the cam retrograde phase.

7. The apparatus of claim 6, wherein the plurality of cams comprises two cams.

8. The apparatus of claim 5, wherein the cam lifting phase is about equal to the cam retrograde phase.

9. The apparatus of claim 8, wherein the plurality of cams comprises two cams.

10. The apparatus of claim 8, wherein the plurality of cams comprises at least three cams.

11. The apparatus claim 1, wherein the motor means is an electric motor.

12. The apparatus claim 11, wherein the electric motor is powered by a battery.

13. A caulking gun apparatus configured to support a cartridge and dispense caulk from the cartridge, the apparatus comprising:

a body configured to hold the cartridge in a dispensing position;

a motor means disposed within the body coupled to a motor shaft;

a plurality of cams axially coupled to the motor shaft; and a piston shaft configured to engage the cartridge for dispensing of the caulk, the piston shaft having a plurality of driving levers in slidable engagement therewith, each of the plurality of cams having surfaces in slidable engagement with at least one of the plurality of driving levers, the surfaces in slidable engagement describing a plane, each of the plurality of planes forming an acute angle with the motor shaft, the planes being positioned such that during rotation, power transmission from the motor to the piston shaft is exchanged between two or more of the plurality of cams through two or more of the plurality of driving levers within a desired power transmission range.

14. The apparatus of claim 13, wherein the plurality of cams comprises three cams.

15. The apparatus of claim 14, wherein the three cams are disposed about a common axis of the motor shaft with a relative phase angle of about 120 degrees.

16. A method for supporting a cartridge and dispensing caulk from the cartridge, the method comprising:

configuring a body to hold the cartridge in a dispensing position;

disposing a motor means within the body;

coupling the motor means to a plurality of cams, each cam having at least one cam surface;

configuring a piston shaft to engage the cartridge for dispensing of the caulk;

engaging the piston shaft with a plurality of driving levers;

slidably engaging each of the cam surfaces with at least one of the plurality of driving levers;

rotating the cams; and positioning the cam surfaces such that during rotation of the cams, power transmission from the motor to the piston shaft is exchanged between two or more of the plurality of cams through two or more of the plurality of driving levers within a desired power transmission range.

17. The method of claim 16, further comprising coupling the motor means to a motor shaft and axially coupling the plurality of cams to the motor shaft.

18. The method of claim 17, further comprising powering the motor means electrically.

19. The method of claim 17, wherein the plurality of cams have uneven surfaces.

20. The method of claim 17, wherein the plurality of cams have about planer surfaces.

* * * * *